United States Patent [19]

Buss

[11] Patent Number: 4,505,466

[45] Date of Patent: Mar. 19, 1985

[54] CLOTH-LAYING MACHINES

[75] Inventor: Albert Buss, Münsingen, Fed. Rep. of Germany

[73] Assignee: Bullmerwerk Karl Bullmer, Musingen, Fed. Rep. of Germany

[21] Appl. No.: 337,180

[22] Filed: Jan. 5, 1982

Related U.S. Application Data

[63] Continuation of Ser. No. 100,694, Dec. 5, 1979, abandoned.

[30] Foreign Application Priority Data

Dec. 6, 1978 [DE] Fed. Rep. of Germany ..... 2852797

[51] Int. Cl.[3] ..... B65H 29/46

[52] U.S. Cl. ..... 270/31

[58] Field of Search ..... 270/30–31; 242/78.8

[56] References Cited

U.S. PATENT DOCUMENTS

| | | | |
|---|---|---|---|
| 1,265,452 | 5/1918 | Isaacs | 270/31 |
| 2,118,556 | 5/1938 | Haberstump | 270/31 |
| 2,965,328 | 12/1960 | Groll | 242/78.8 |
| 3,145,989 | 8/1964 | Cavrich | 270/31 |
| 3,181,859 | 5/1965 | Sayles | 270/31 |
| 3,227,390 | 1/1966 | Wendelken | 270/31 |
| 3,606,303 | 9/1971 | Johnson | 270/31 |
| 3,645,524 | 2/1972 | Grimm | 270/31 |

FOREIGN PATENT DOCUMENTS

| | | | |
|---|---|---|---|
| 1264533 | 2/1972 | United Kingdom | 270/31 |

*Primary Examiner*—A. J. Heinz

*Attorney, Agent, or Firm*—Scully, Scott, Murphy and Presser

[57] ABSTRACT

A cloth-laying machine comprising a laying carriage adapted for reciprocating movement over a cloth-laying surface. A supply of a cloth web on a roll is supported on the laying carriage, and a driving member is provided to entrain a free end of the cloth hanging from the roll, regardless of which side of the roll the cloth may be hanging from. The driving member entrains the end of the cloth web and guides it into a gap between a deflecting roller and an unwinding roller, the latter roller being provided to lay the cloth over a cloth-laying surface.

11 Claims, 8 Drawing Figures

CLOTH-LAYING MACHINES

This is a continuation of application Ser. No. 100,694, filed 12/5/79, now abandoned.

BACKGROUND OF THE INVENTION

This invention relates to a cloth-laying machine and is more particularly concerned with a machine of the type which comprises a laying carriage which is movable backwards and forwards over a laying surface and carries a cloth supply which is to be laid out.

The carriage comprises, in the region of one end thereof, as seen in the direction of movement of the carriage and laterally of the cloth supply, an unwinding roller which is arranged to draw cloth from the supply and to lay it on the laying surface.

In use, the unwinding roller will be provided with a rotatable drive means so that the cloth web depending from the cloth supply is engaged over the unwinding roller and a closely adjacent deflecting roller is provided beneath which the cloth web is to engage before it engages over the unwinding roller. The laying carriage is provided with a movable driving member to grip the cloth web initially depending freely from the cloth supply, the driving member being arranged to feed the freely hanging end into the gap between the deflecting roller and the unwinding roller.

The cloth supply usually consists of a bale or reel, through which is pushed a winding shaft which extends parallel to the unwinding roller and the ends of which are moved in bearings of a supporting device on the laying carriage. The unwinding roller is preferably capable of being driven in synchronism with the transporting mechanism of the laying carriage, the driven unwinding roller causing the withdrawal of the cloth web from the cloth supply in order to produce a tension-free laying out of the cloth web on the laying surface. The deflecting roller serves to produce the necessary wrapping angle of the cloth web on the unwinding roller.

A cloth laying machine of a different type is known from German Auslegeschrift No. 1932508. No deflecting roller is provided in this machine and the unwinding roller provided with a rotational drive means is not disposed laterally of the cloth supply, but bears from beneath against the cloth bale at the bottom surface line of the bale forming the cloth supply. The cloth web to be unwound from the cloth bale extends through the gap which is disposed between the unwinding roller and the cloth bale and then travels in the form of a loose C-shape loop onto a conveyor belt which is situated beneath the unwinding roller and which is extended by a separate laying-out conveyor belt for laying out the cloth on the laying surface. The initially mentioned problem of producing a wrapping angle on the unwinding roller and thus the arrangement of a driving member for introducing the depending cloth web into the gap which is situated between a deflecting roller and the unwinding roller does not arise with this known construction since the premise with the latter is that the end of the cloth web initially adheres on the cirumference of the cloth bale, and with rotation of the latter, passes with its edge through the gap between the cloth bale and unwinding roller and is then detached from the bale under the action of a fan, so as then to reach the conveyor belt which is disposed underneath the unwinding roller and with formation of the loose C-shaped loop which embraces the unwinding roller in a large arc and then to be carried away. With a large number of types of cloth or materials which have to be laid out, more especially when these have a smooth surface or a comparatively stiff consistency, the end of the cloth web does not remain adhering to the cloth bale, but already hangs down before reaching the unwinding roller situated beneath the cloth bale onto the conveyor belt which continues the transporting of the cloth web. More particularly with a decreasing cloth supply, difficulties arise in such a case, and these difficulties require the provision of control or braking devices in order to compensate the changes of the cloth bale circumference in proportion to the conveyor belt speed.

A cloth laying machine of the type as initially referred to is known from German Auslegeschrift No. 1635423. In the latter, the driving member consists of a rail which is approximately L-shaped in cross-section and is mounted to be pivotable about a shaft extending parallel to the unwinding roller and on one end of the laying carriage, which rail is movable with its free edge, carrying with it the cloth web hanging down from above and from beneath between the unwinding roller and the deflecting roller. The result obtained by this construction is that a cloth web which is hanging down on that side, opposite the two rollers, of the cloth supply which always has a certain width in the direction of travel of the laying carriage, cannot be gripped by the rail, since the path of movement thereof is only very restricted and is only provided in the region of one end of the laying carriage. The cloth web in this case thus has to be pushed by hand into the gap between the two rollers.

OBJECT OF THE INVENTION

The invention has for its object to provide a cloth laying machine of the type as initially referred to, in which a gripping of the cloth web depending from above and then an automatic feeding into the gap between unwinding roller and deflecting roller is possible and in fact independently of the side on which the cloth web is hanging down from the cloth supply.

SUMMARY OF THE INVENTION

According to the present invention, there is provided, in a cloth laying machine, a laying carriage adapted for reciprocating movement over a cloth-laying surface and arranged to support in a predetermined position a supply of cloth on a roll, the laying carriage comprising, laterally of the intended direction of cloth supply, an unwinding roller to draw cloth from the supply and to lay it on said surface, a driving member to entrain a freely hanging end of the cloth, and a deflecting roller, said driving member being arranged to feed said freely hanging end into a gap between said deflecting roller and said unwinding roller so that the cloth engages beneath said deflecting roller and over said unwinding roller, the improvement comprising said driving member being further arranged to entrain said freely hanging end of the cloth whatever may be the maximum outermost positions that the cloth can hang from a roll if the roll be supported in said predetermined position and be turned through 180° about a vertical axis.

BRIEF DESCRIPTION OF THE DRAWINGS

For a better understanding of the invention and to show how the same may be carried into effect, reference will now be made, by way of example, to the accompanying drawings, in which.

DESCRIPTION OF THE PREFERRRED EMBODIMENTS

Figure 1:
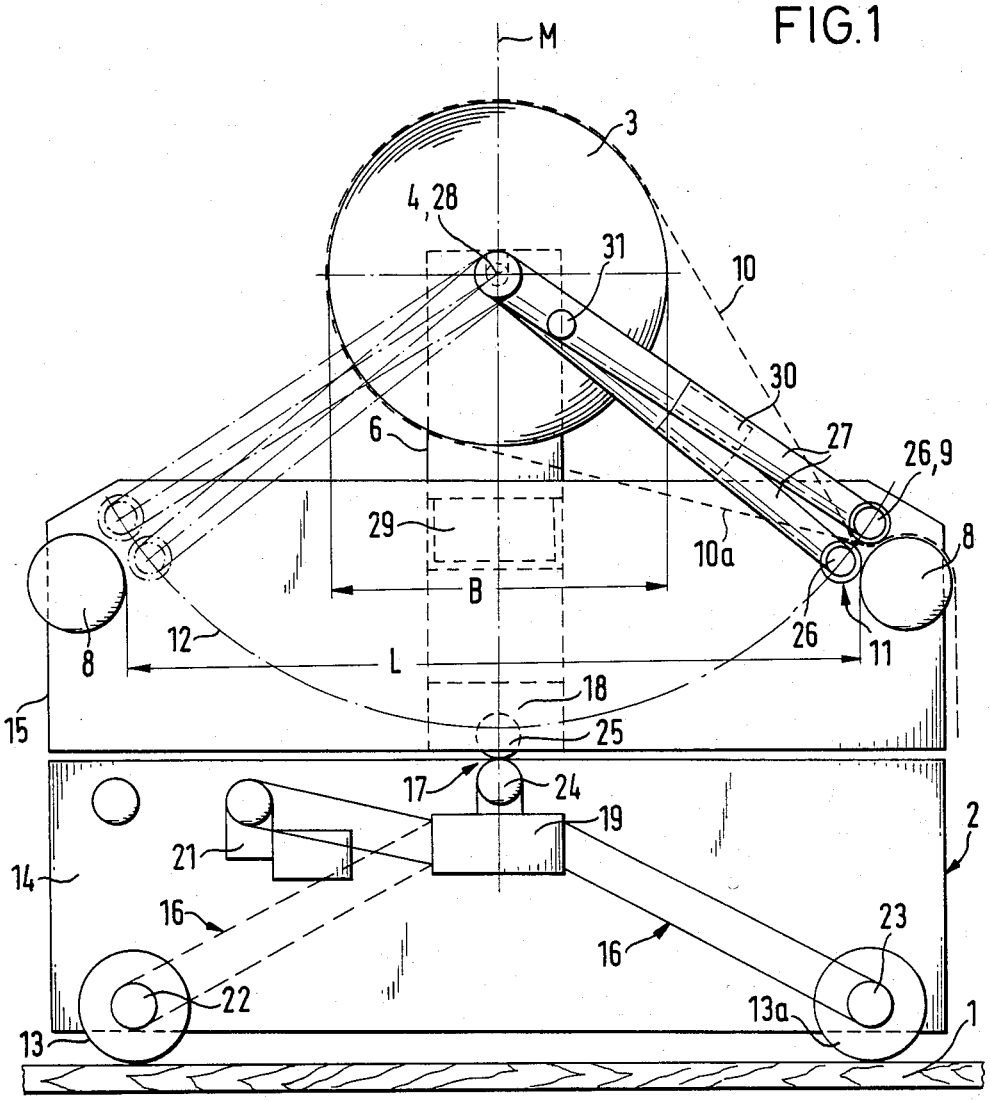
FIG. 1 is a side view of a first form of cloth-laying machine, looking towards a laying carriage thereof.
Figure 5:
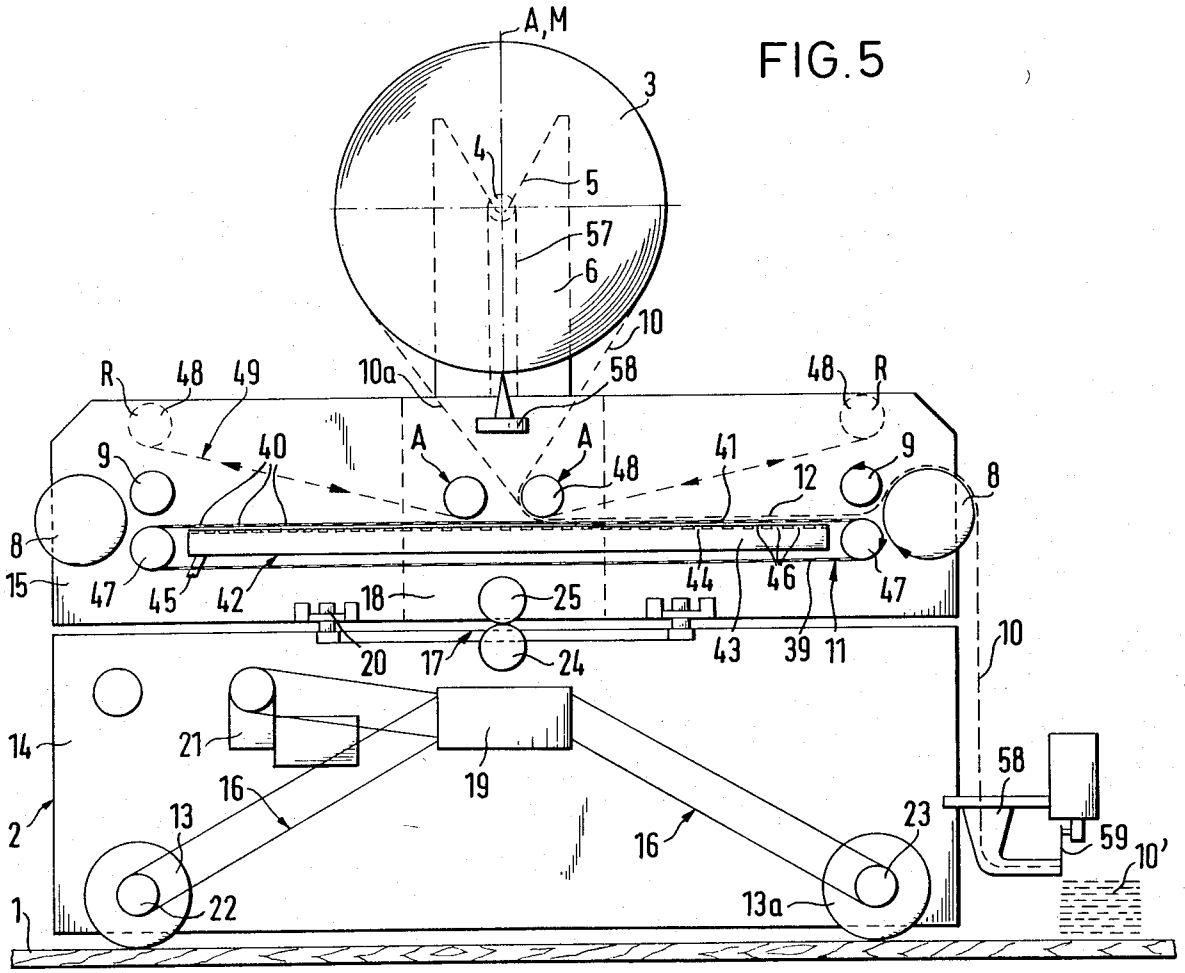
FIG. 5 is a view similar to FIG. 1 of a third form of cloth-laying machine and showing the path of travel of a web of cloth.
Figure 6:
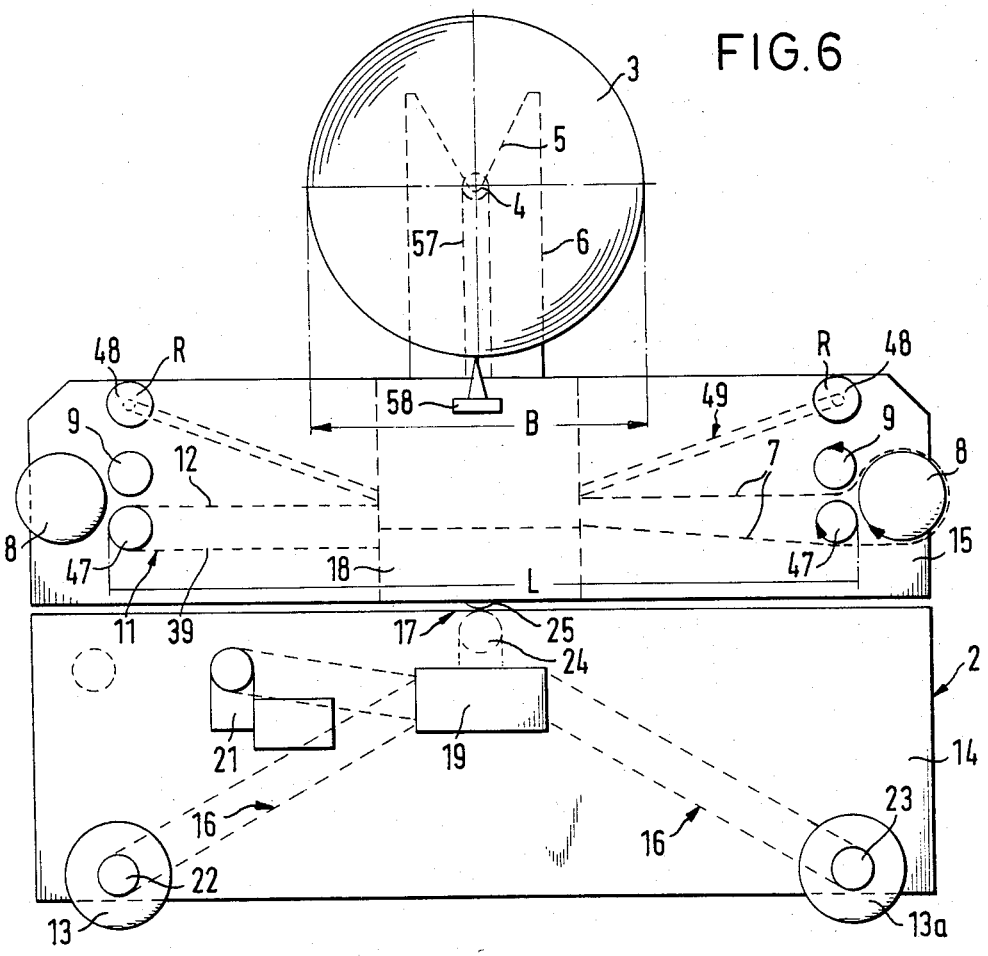
FIG. 6 is a view similar to FIG. 5 but modified to show the path of an endless driving means.

Referring firstly to FIG. 1 of the drawings, the cloth-laying machine includes a laying carriage 2, which is movable backwards and forwards above a laying surface 1, e.g. the table top of a laying table, and which carries a supply 3 of cloth in the form of a cloth roll or bale, which supply is to be laid out and which is arranged centrally of the laying carriage 2 in FIGS. 1, 5 and 6. The cloth bale is mounted by means of a winding shaft 4 pushed therethrough in bearings of a support arrangement 6 on the laying carriage 2. Typical bearings are the bearings 5 shown in FIG. 6.

In the region of its two ends, the laying carriage 2 has in each case, laterally of the cloth supply 3, an unwinding roller 8 provided with an endless drive means 7 (FIG. 6) with associated adjacent deflecting roller 9. As shown more particularly in FIGS. 1 and 5, each unwinding roller 8 is positioned so that a web 10 of cloth depending from the cloth supply 3 runs over one of them, while the deflecting roller 9 is positioned so that the web 10 of cloth firstly runs beneath it before running over the roller 8. The purpose of the unwinding roller 8 is to draw cloth from the supply 3 and to lay it in a pile 10' (FIG. 5) upon reciprocating movement of the carriage 2. A driving member 11 is provided on the laying carriage 2, the driving member 11 engaging the cloth web 10 initially depending freely from above. The driving member 11 is movable and transports the cloth web 10 substantially from beneath or from the side of the roll of cloth into the gap between the deflecting roller 9 and unwinding roller 8 until the transfer to the latter has been effected so that further transport is effected by the unwinding roller 8.

Figure 2:
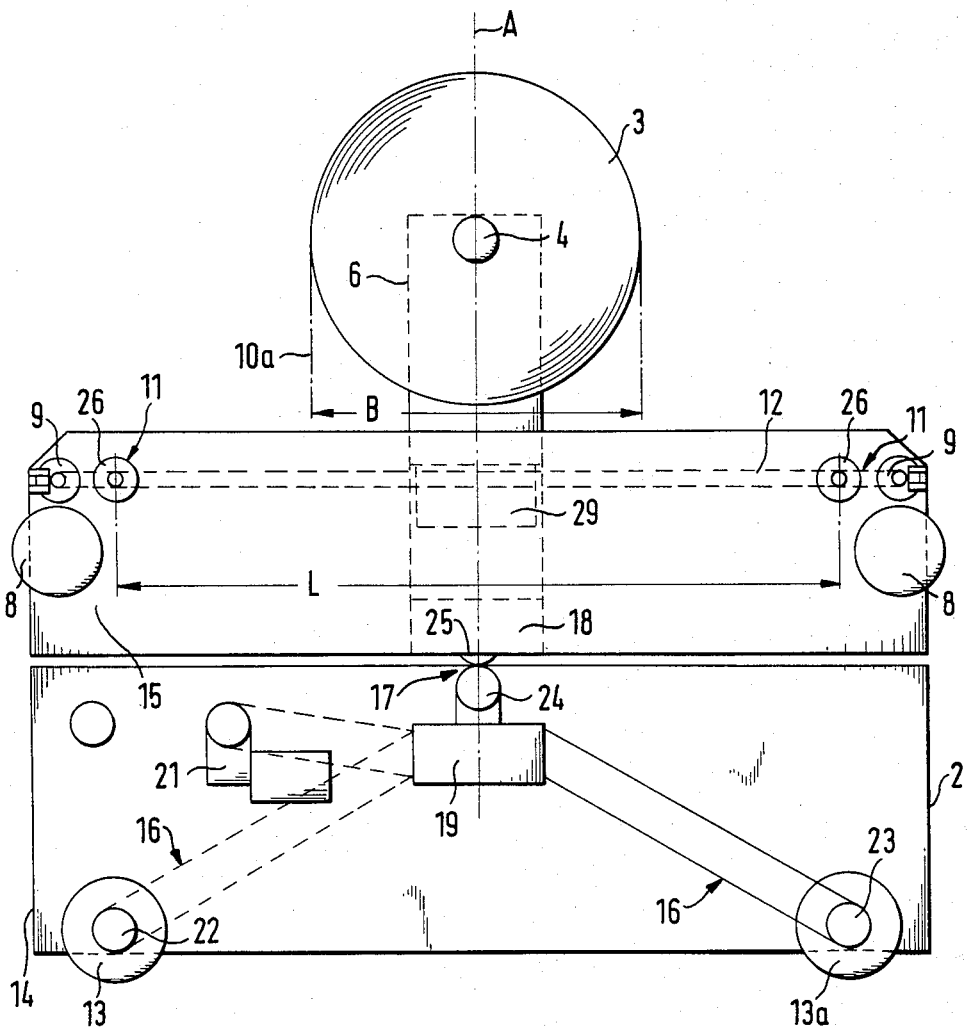
FIG. 2 is a view similar to FIG. 1 of a second form of cloth-laying machine.

In the machine shown in FIG. 1, the path of movement 12 of the driving member 11, in the zone beneath the cloth supply 3, extends along an arc, whereas this path of movement 12 in the machines shown in FIGS. 2, 5 and 6 extends rectilinearly and horizontally. The movement path 12 (FIGS. 2, 5 and 6), or its corresponding horizontal component or projection in the case of FIG. 1, has, in all constructional forms, a length L covering or exceeding the maximum horizontal width B of the cloth supply 3 as defined by the freely depending cloth web 10 or 10*a* in the two possible positions it can hang, these two positions being effectively defined by turning the supply roll 3 through 180° about a mean vertical axis A (FIGS. 1, 2 and 6).

As shown in FIGS. 1, 2, 5 and 6, the laying carriage 2 consists of a lower part 14 comprising track wheels 13, 13*a* and an upper turning part 15 which is rotatable through 180° about its vertical mean axis M which moreover coincides with the axis A. The cloth supply 3, the unwinding roller 8, the deflecting roller 9 and the driving member 11 are all arranged on the part 15. So as to facilitate an easier turning of the part 15, a turntable or ring mounting 20 (FIG. 5) is arranged between the two parts 14 and 15. The track wheels 13, 13*a*, at least of one side of the lower part 14 of the laying carriage, can be guided in a manner not shown by at least one rail which is arranged on the laying surface 1.

The lower part 14 of the laying carriage 2 is provided with a transporting drive means 16 acting on the track wheels 13, 13*a*. Included in this driving means is an electric driving motor 21, which drives one track wheel shaft 22. A change-speed gear 19 is connected by way of a clutch 17 consisting of a friction roller or toothed wheel 24 of the lower laying carriage part 14 and a friction roller or a toothed wheel 25 of the upper laying carriage or reversing part 15 to a drive 18 of the upper laying carriage part 15, which drive comprises a gearing and causes the movement of the driving member 11 along the movement path 12. The change-speed gear 19 has a double clutch, so that either the movement drive 18 for the driving member 11 can be engaged by the driving motor 21 or the track wheel 13*a*.

With the form shown in FIG. 1, the driving member 11 is formed by two driving rollers which extend parallel to the unwinding rollers 8 and of which one forms the deflecting roller 9 after reaching the transfer position enabling the transfer of the cloth web 10 to the unwinding roller 8.

In the form shown in FIG. 2, the deflecting roller 9 is fixedly arranged, while in turn two driving rollers 26 are provided, and in fact substantially adjoining one another on their movement path 12, similar to the arrangement in FIG. 1.

The form shown in FIG. 1 is so developed that the two driving rollers 26 are each mounted on the free end of a swinging or pivotable arm 27 with a common horizontal pivot shaft 28. The two swinging arms 27, with their driving rollers 26, hold the cloth web 10 between them and for reasons of, for example, an increased wrapping angle of the cloth web 10 on the unwinding roller 8, so as to make possible an even better slip-free withdrawal of the cloth web 10 from the cloth bale forming the cloth supply 3, it would in certain cases be expedient to provide three or more driving rollers. The swinging arms 27 are mounted on the cloth supply support arrangement 6 and so it is possible for the pivot shaft 28 to coincide with the winding shaft 4. The support arrangement 6 is capable of being adjusted in height by means of a telescopic arrangement 29 in order to be adapted to different diameters of cloth bales, in both the FIG. 1 and the FIG. 2 embodiments. In addition, the embodiment shown in FIG. 1 requires that the arms 27 be adjustable in length, this preferably being achieved by means of a telescopic arrangement 30, a latch device 31 being provided on the laying carriage 2 for the releasable locking of the arms 27 in the pivoted position corresponding to the transfer position of the driving roller 26.

Figure 3:
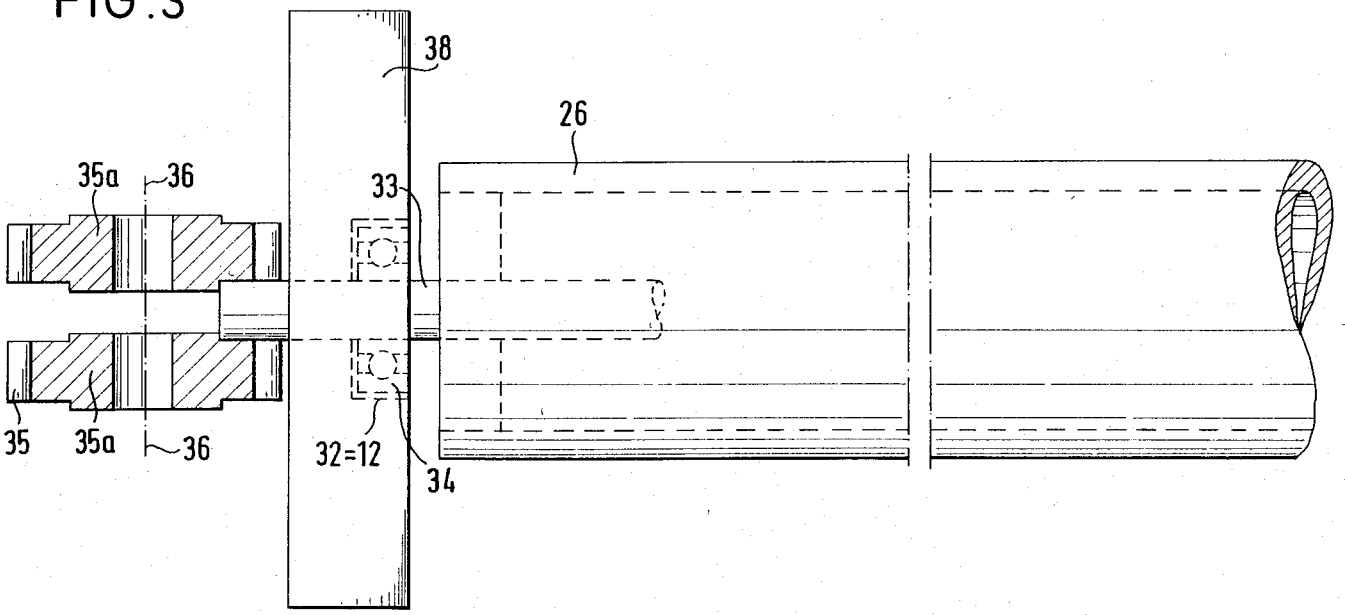
FIG. 3 is a plan view of a detail of the machine shown in FIG. 2.
Figure 4:
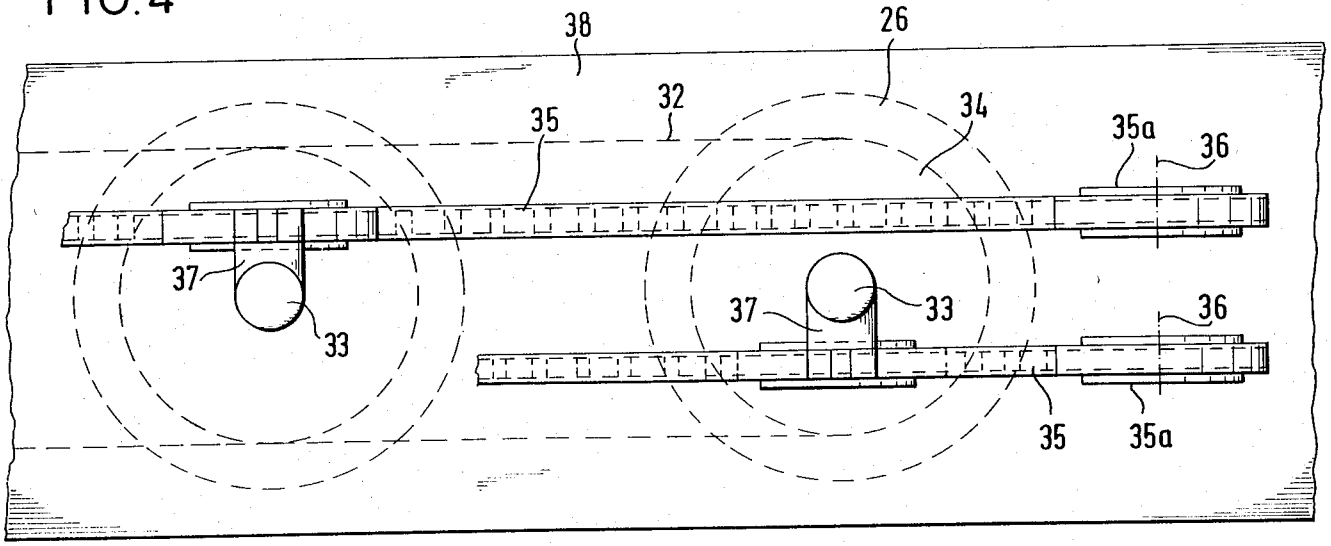
FIG. 4 is a side view of the detail shown in FIG. 3.

In the FIG. 2 form, the driving rollers 26 are, as shown in FIGS. 3 and 4, mounted with their shaft ends 33 in groove-like guideways 32 of a side part 38 of the reversing or turning part 15 of the laying carriage 2, which guideways determine the path of movement 12 of the rollers 26. For this purpose, the shaft ends 33 are mounted in guide bearings 34, which are in their turn mounted in the guideways 32 and are fixed on endless driving members 35 such as chains or cables which extend along the respective guideways. Deflecting wheels 35*a*, e.g. deflecting sprockets, which have vertical pivots 36, are provided for the driving members 35 and holding clips or clamps 37 serve to fix the shaft ends 33 to the driving members 35.

Instead of the driving member 11 being constructed, as shown in FIGS. 1 to 4 in the form of one or more driving rollers or cylinders 26, it is also possible for it to be formed by a conveyor belt 39, as shown in FIGS. 5 to 8.

The conveyor belt 39 extends horizontally and is capable of being driven, advantageously so as to be able to be reversed, by the drive 18. The conveyor belt 39 is made so as to be air-permeable; for this purpose, it may consist of air-permeable material or, in the event of being formed of an air-impermeable material, it can be provided with holes 40. Arranged underneath an upper run 41 of the conveyor belt 39 is an air-suction device 42 by which the cloth web 10 coming into a position to lie on the conveyor belt 39 is retained on the latter, the device 42 consisting of a compartment 43 engaging underneath the upper run 41 of the conveyor belt 39 and in the form of a flat box having a perforated or air-permeable upper wall 44, the compartment 43 having a connection 45 to be connected to a vacuum source which is not shown. Some of the perforations 46 in the upper wall 44 are indicated in FIG. 5. The belt 39 is engaged around and can travel around deflecting rollers 47. The belt-deflecting roller 47 to the right in FIG. 6 is capable of being driven by means of the endless drive means 7 itself driven by the drive 18.

Figure 7:
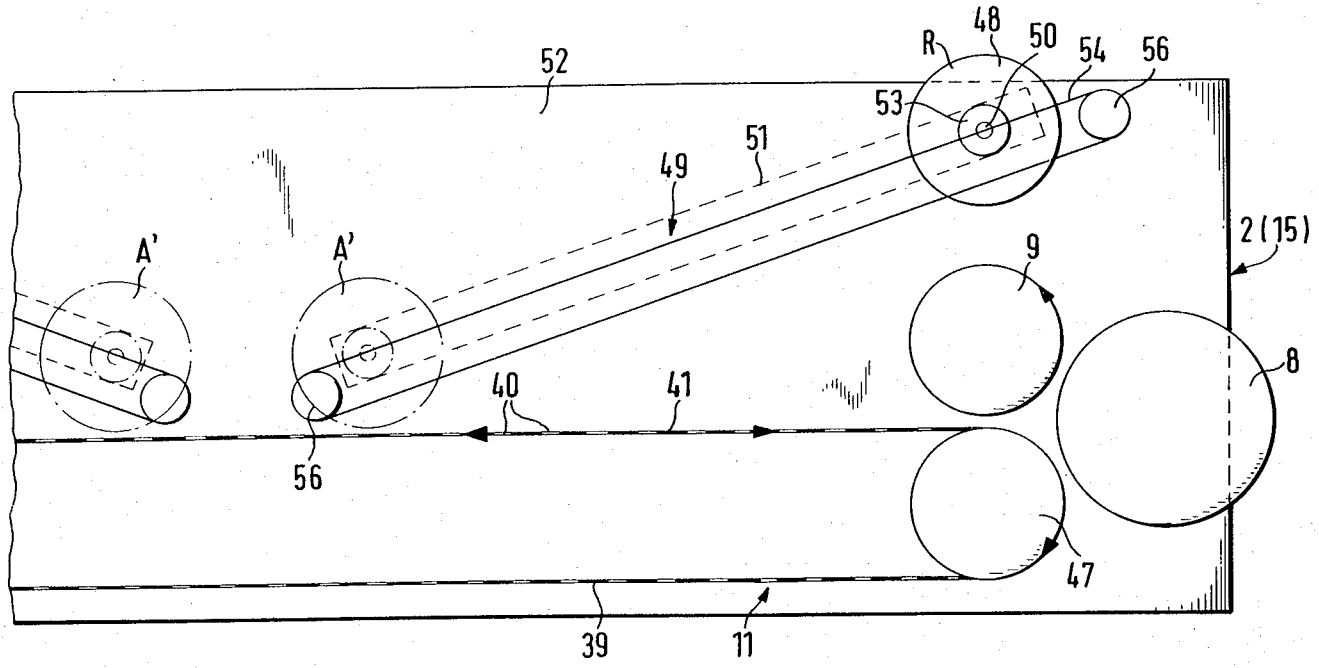
FIG. 7 is a side view of a detail of the machine shown in FIGS. 5 and 6.
Figure 8:
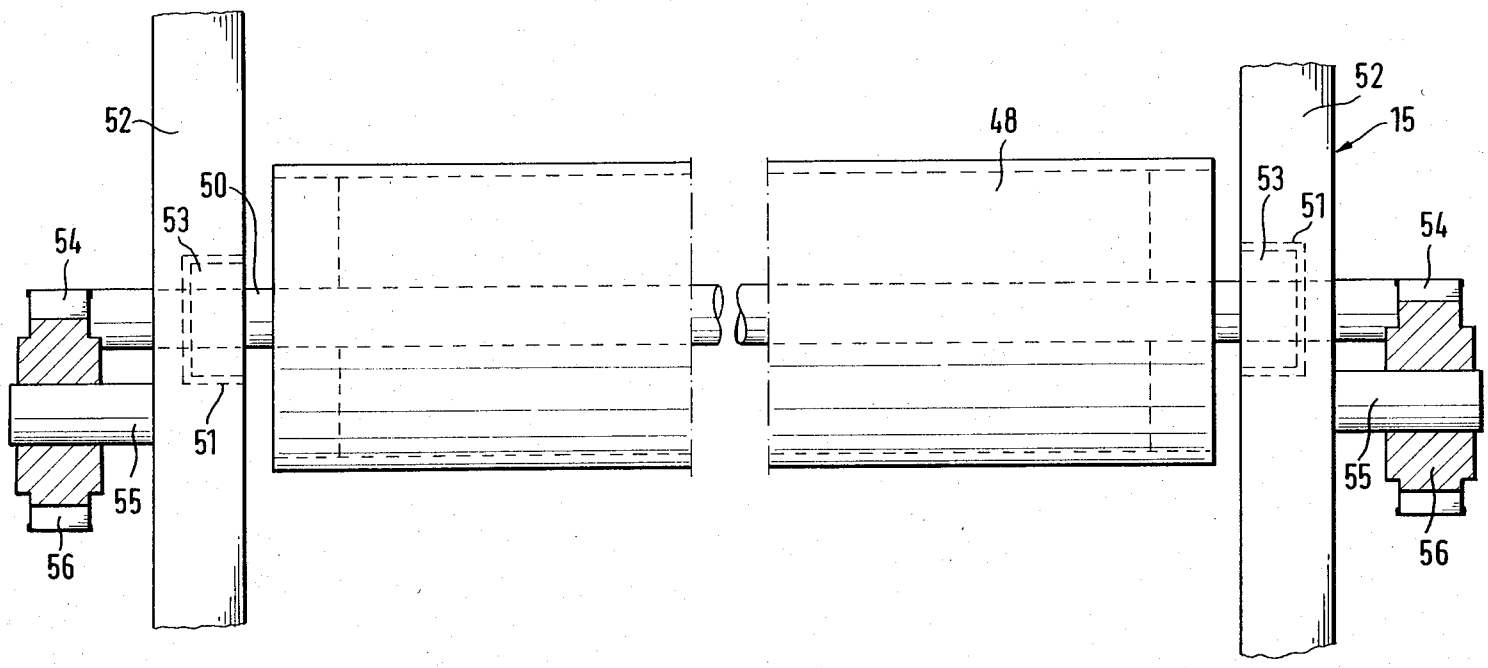
FIG. 8 is a front view of the detail shown in FIG. 7.

As will be apparent from FIGS. 5 to 8, the deflecting rollers 9 respectively associated with the two unwinding rollers 8 are arranged in fixed positions, each deflecting roller 9 having associated therewith a holding roller 48 which presses the cloth web on to the upper run 41 of the conveyor belt 39 and, as a result, assists the positioning of the cloth web on the conveyor belt and the driving thereof. After the cloth web 10 has been threaded into the gap existing between the deflecting roller 9 and unwinding roller 8, each holding roller 48 is moved from its pressure-applying position A' pressing the cloth web 10 on to the conveyor belt 39 into a rest position R which is located above each of the two deflecting rollers 9. For this purpose as shown in FIG. 6, the holding roller 48 are provided with a movement drive 49, which in suitable manner, possibly with interposition of controlling switch elements which are not shown, is connected to the drive 18 for the conveyor belt 39. For this purpose, as shown in FIGS. 7 and 8, the holding rollers 48 are mounted with their shaft ends 50 in guideways 51 of the laying carriage 2 or of a side portion 52 of the upper turning part 15 of the carriage 2, the guideways 51 extending from the pressure-applying position A as far as the rest position R. In this case, in a manner similar to that shown in FIGS. 3 and 4, the shaft ends 50 are mounted in guide bearings 53, which in their turn are mounted in the groove-like guideways 51 and are fixed on driven endless driving members 54 which extend along the guideways.

As will be seen from FIGS. 7 and 8, the driving members 54 are each positioned around deflecting wheels 56, e.g. deflecting chain wheels in the case of a chain driving member, which wheels have horizontal shafts 55 to allow rotation thereof.

As shown in FIGS. 5 and 6, the winding shaft 4 pushed through the roll of cloth which forms the cloth supply 3 is connected through a transmission member 57, e.g. a chain, to the drive 18 causing the movement of the driving member 11, in order to rotate the cloth bale. In connection with the type of cloth bale mounting shown, which is particularly suitable for the feeding operation, because the diameter of the bale decreases during the unwinding operation, this rotational drive of the bale has advantages in construction as compared with another type of drive means, for example, a friction pulley or roller acting directly on the cloth bale.

With the form shown in FIGS. 5 and 6, a stripper element 58 is provided for detaching the leading end of the cloth web from the cloth bale, which element can be constructed in the form of a brush extending along one surface line of the cloth bale and can be made so that it can be arrested and adjusted radially, following the decreasing diameter of the cloth bale.

The various possible operational procedures in respect of the cloth-laying machine provided with the driving member 11 are as follows.

(A) Laying carriage with a driving roller 26

What is involved here is a constructional form which is modified as compared with that shown in FIGS. 1 and 2 in such a way that only one driving roller is provided, instead of the two driving rollers 26 which are illustrated, in which case at one end of the ends of the turning part 15 of the laying carriage 2 (or as illustrated, at both ends) an unwinding roller 8 and a fixed deflecting roller 9 associated with the latter are provided.

To effect the feeding operation, the driving roller 26 is moved so far away from the unwinding roller 8 or from the required unwinding roller 8 that the cloth web 10, initially disposed with its end above the path of movement 12 of the driving roller 26 and depending freely from the left side or the right side, according to the side with which the cloth web 10 is to be laid on the laying surface 1, of the cloth bale forming the cloth supply 3 is disposed between the driving roller 26 and that unwinding roller 8. The cloth web 10 is then moved by hand or by a brief switching on of the rotatable drive of the cloth bale into the movement path 12 and thereafter the driving roller 26 is moved along its path 12 up to the unwinding roller 8, which roller, by its rotational drive means, pulls the cloth web 10 into the gap between the unwinding roller 8 and deflecting roller 9 in such a way that the cloth web 10 as required, first of all engages underneath the deflecting roller 9 and thereafter engages over the unwinding roller 8. From the latter, the cloth web 10 runs downwardly and is laid out on the laying surface 1 in successive layers to form the pile 10' and without any tension by means of a guiding device 58 which is arranged on the laying carriage 2 and which is shown by way of example in FIG. 5. At the end of each single travel of the laying carriage 2, each laid-out layer forming the pile 10' can be cut off from the cloth web 10 coming from above by means of a transverse cutting device 59 likewise arranged on the laying carriage or, with the return travel of the laying carriage 2, can be laid out in zig-zag formation without being cut off. This feeding and laying out proceeds in each case in the manner as described and in fact independently of whether the cloth bale is suspended so as to hang down into the support device 6 with the cloth web 10 on the right-hand side or with the cloth web 10*a* (FIGS. 1 and 5) on the left-hand side.

(B) Laying carriage 2 with two driving rollers 26

First of all, the constructional form shown in FIG. 1 is discussed. For the feeding operation, the two driving rollers 26, by suitable swinging of the pivotal arms 27, are moved so far apart that the cloth web 10 coming from above passes between the driving rollers 26. The arrangement can be so devised that the two driving rollers 26 are then moved towards one another by their movement drive 18, with clamping of the cloth web, when the free end of the web reaches a mechanical or photo-electric stop or abutment (not shown) on the laying carriage 2. After the movement towards one another of the driving rollers 26, which has taken place with inclusion of the cloth web 10, the rollers are moved together, about their common axis, carrying with them the web 10, until the latter is transferred to the required unwinding roller 8, the driving roller 26 which is in the outer position, relative to the carriage 2, now taking over the function of the deflecting roller.

For the feeding operation as regards a so-called paired laying, the two driving rollers or cylinders 26, carrying with them the cloth web 10 which is held between them, are moved along their path 12 beneath the cloth supply 3 towards the opposite unwinding roller 8 which is on the left in FIG. 1. Such a changed transfer position, in which now the other of the two driving rollers 26 assumes the purpose of the deflecting roller adjacent the left-hand unwinding roller 8, is shown in chain-dotted lines in FIG. 1. The reversing or turning part 15 is now rotated about the vertical mean axis M, possible by means of the ring gear or turntable 20 (FIG. 5) through 180°, until the clutch 17 is once again engaged, whereupon the paired laying of the cloth web 10 can take place.

The same operating procedure is possible with the aid of the constructional form shown in FIG. 2, except that the movement path 12 of the driving rollers 26 is not along an arcuate path, but along a horizontal path.

If a paired laying is not to take place, but only a laying operation in a single direction or in zig-zag form, it is also possible to operate with only one unwinding roller for the feeding operation, in which case the second unwinding roller is left permanently in the position of the deflecting roller.

(C) Laying carriage 2 with conveyor belt 39 alone

What is involved here is a constructional form which is modified as compared with FIGS. 5 and 6 in such a way that neither an air-suction device 42 nor a holding roller 48 is provided, an unwinding roller 8 and a fixed deflecting roller 9 associated with the latter being provided on one end or, as shown, on both ends of the turning part 15.

If now the cloth web 10 which is to be fed reaches the conveyor belt 39, it is moved along the path of movement 12 of the belt as far as the unwinding roller 8. The conveyor belt 39 then takes over the task of the driving rollers 26 shown in FIGS. 1 to 4. Otherwise, feeding and laying can be effected automatically in accordance with (A) and (B).

(D) Laying carriage with air-pervious conveyor belt 39 and air-suction device 42

The air-permeability of the conveyor belt 39 and the air-suction device 42 serve to improve the adhesion and thus the better carrying along of the cloth web 10 on the conveyor belt 39 with certain types of cloth, for example, smooth cloth such as synthetic plastics, silk, etc.. The air suction only needs to be maintained until the cloth web 10 has passed through the gap between the unwinding roller 8 and the deflecting roller 9.

(E) Laying carriage with conveyor belt 39 and holding rollers 38

In the most advantageous arrangement, the holding rollers 48 can be provided additionally to the air-permeability of the conveyor belt as mentioned under (D) and the air suction device, or instead thereof.

Depending on the required type of laying, a holding roller 48 (for laying in the straight direction or in zig-zag form) or two holding rollers 48, each with an unwinding roller 8 having an associated deflecting roller 9, can be provided at each end of the laying carriage 2 (for paired laying). Before the feeding operation, the holding rollers 48 are moved into the rest position R. While the cloth bale forming the cloth supply 3 is unwound and the free end of the web 10 comes closer to the conveyor belt 39, the holding rollers 48 which are not, like the deflecting rollers 9, provided with a rotational drive means, are moved into the pressure-applying position A. In his case, the speed of movement of the holding rollers 48 is so chosen that the free end of the cloth web 10 is already on the conveyor belt 39, driven since the commencement of the downward movement of the cloth web, when the holding rollers 48 move into the pressure-applying position A. The holding rollers 48 remain in the pressure-applying position A until the cloth web 10 has passed through the gap between the unwinding roller 8 and the deflecting roller 9 and in this way provide a reliable transport of the cloth web to its feeding position between the rollers. Thereafter, the holding rollers can be once again moved into the rest position R.

It will be appreciated that the above described machine allows the cloth web hanging from the supply roll to be fed, independently of in which of the two possible positions of the cloth supply the web is hanging so as to be gripped by the driving member and can be transported into the gap between the deflecting roller and unwinding roller to the point of the transfer to the latter. Consequently, with laying carriages having one unwinding roller on only one end of the laying carriage, the operator no longer has to take care, as regards the arrangement of the cloth supply on the laying carriage, that the cloth web hanging down during the unwinding is disposed on the side of this unwinding roller. Likewise, the cloth supply can be deliberately arranged on the laying carriage in a position in which the cloth web hangs down on the other side, which occasionally is even desirable, and in fact when the cloth web is to be laid out with its other side on the laying surface.

I claim:

1. A cloth-laying machine comprising a laying carriage positioned above a cloth-laying surface, a cloth supply roll positioned above said carriage, said cloth supply roll having cloth disposed thereon, said cloth having an end extending downwardly from a side of said roll, means for entraining and transporting said end from said roll to a gap between a deflecting roller and an unwinding roller, said rollers being remotely positioned from the cloth supply roll, said unwinding roller having means to draw cloth from the cloth supply roll along a path to said gap, said means for entraining and transporting said end comprising an endless conveyor which is positioned below the supply roll to transport the cloth end from said cloth supply roll to the deflecting roller and uwinding roller located next to an end of the conveyor, the deflecting roller and the unwinding roller being positioned adjacent to each other and forming a nip therebetween including the gap for receipt of the end of the cloth, said deflecting roller being positioned along said path upstream of said unwinding roller so that the end engages the deflecting roller before it engages the unwinding roller to produce a desired amount of wrap of cloth about the surface of the unwinding roller, the unwinding roller causing the withdrawal of the cloth from the supply roll in a manner producing a tension-free laying of the cloth on the cloth-laying surface and the deflecting roller serving to produce the necessary wrapping angle of the cloth on the unwinding roller, and the endless conveyor adapted to automatically engage the end of the cloth regardless of the side of the supply roll from which the end extends and to direct the end to either end of the laying carriage for engagement with an unwinding roller and a deflecting roller.

2. A cloth-laying machine as defined in claim 1 wherein an upper part of said laying carriage is rotatable 180° transverse to a vertical axis of said cloth supply roll.

3. A cloth-laying machine, comprising a laying carriage adapted for reciprocating movement over a cloth-laying surface and arranged to support in a predetermined position a supply of a cloth web on a roll, the laying carriage comprising, laterally of the cloth supply, an unwinding roller to draw cloth from the supply and to lay it on said surface, a driving member to entrain a freely hanging end of the cloth, and a deflecting roller, said driving member feeding the freely hanging end between said deflecting roller and said unwinding roller, the improvement comprising said driving member (11) being formed by an arrangement of two driving rollers (26) each mounted on a pivot arm (27), pivoted relative to a common horizontal pivot axis (28), and being movable on a path extending up to at least one end surface of the laying carriage (2) at which is arranged said uwinding roller (8) in a horizontal position, said path having a length (L) within which can engage the freely hanging end of the cloth web (10) from the cloth supply roll (3), and also encompassing substantially 180° relative to a vertical axis (A) and the cloth supply roll (3).

4. Cloth-laying machine according to claim 3, characterized in that the pivot arms (27) are supported by a carrying arrangement (6) of the laying carriage (2) for receiving the cloth supply roll (3).

5. Cloth-laying machine according to claim 4, characterized in that the carrying arrangement (6) is vertically displaceable to adjust its height, and said pivot arms (27) include means for adjusting their lengths.

6. A cloth-laying machine according to claim 3 or 4 or 5, having a winding shaft rotationally driving and carrying the cloth supply roll, characterized in that a stripper member is provided for detaching a leading end of the cloth web from the cloth supply roll (3).

7. A cloth-laying machine according to claim 6, characterized in that said stripper includes a brush extending longitudinally along a surface line of the roll of cloth (3).

8. A cloth-laying machine, comprising a laying carriage adapted for reciprocating movement over a cloth-laying surface and arranged to support in a predetermined position a supply of a cloth web on a roll, the laying carriage comprising, laterally of the cloth supply, an unwinding roller to draw cloth from the supply and to lay it on said surface, a driving member to entrain a freely hanging end of the cloth, and a deflecting roller, said driving member feeding the freely hanging end between said deflecting roller and said unwinding roller, the improvement comprising said driving member (11) being formed by an endless air permeable conveyor belt (39) in which an air suction arrangement (42) is arranged below an upper run (41) of said conveyor belt, and being movable on a path extending up to at least one end surface of the laying carriage (2) at which is arranged said unwinding roller (8) in a horizontal position, said path having a length (L) within which can be engaged the freely hanging end of the cloth web (10) from the cloth supply roll (3), and also encompassing substantially 180° relative to a vertical axis (A) and the cloth supply roll (3).

9. A cloth-laying machine according to claim 8, characterized in that said air suction arrangement (42) includes a compartment (43) beneath the upper run (41) of the conveyor belt (39) in the form of a flat box with a perforated upper wall (44), and the compartment (43) has a connection (45) to a vacuum source.

10. A cloth-laying machine according to claim 9, characterized in that each unwinding roller (8) has a deflecting roller (9) fixedly arranged thereto, and each deflecting roller (9) has associated therewith a holding roller (48) pressing the cloth web (10) on the conveyor belt (39).

11. A cloth-laying machine according to claim 9, characterized in that each unwinding roller (8) has a deflecting roller (9) fixedly arranged thereto and each deflecting roller (9) has associated therewith a holding roller (48) pressing the cloth web (10) on the conveyor belt (39).

* * * * *